US008464973B2

(12) United States Patent
Karlsson et al.

(10) Patent No.: US 8,464,973 B2
(45) Date of Patent: Jun. 18, 2013

(54) GRANULATOR MILL

(75) Inventors: Henrik Karlsson, Värnamo (SE); Kurt Sjöberg, Bredaryd (SE); Ulf Henning, Värnamo (SE)

(73) Assignee: Rapid Granulator AB, Bredaryd (SE)

( * ) Notice: Subject to any disclaimer, the term of this patent is extended or adjusted under 35 U.S.C. 154(b) by 251 days.

(21) Appl. No.: 12/996,890

(22) PCT Filed: Jun. 30, 2009

(86) PCT No.: PCT/SE2009/000341
§ 371 (c)(1),
(2), (4) Date: Dec. 8, 2010

(87) PCT Pub. No.: WO2010/005356
PCT Pub. Date: Jan. 14, 2010

(65) Prior Publication Data

US 2011/0095114 A1 Apr. 28, 2011

(30) Foreign Application Priority Data

Jul. 9, 2008 (SE) ..... 0801651

(51) Int. Cl.
*B02C 23/00* (2006.01)

(52) U.S. Cl.
USPC ..... 241/285.3

(58) Field of Classification Search
USPC ..... 241/285.1, 285.2, 285.3, 73
See application file for complete search history.

(56) References Cited

U.S. PATENT DOCUMENTS

| | | | | | |
|---|---|---|---|---|---|
| 246,992 | A * | 9/1881 | Anderson | 241/138 |
| 2,756,002 | A * | 7/1956 | Brake | 241/285.3 |
| 4,000,860 | A * | 1/1977 | Gotham | 241/242 |
| 4,609,157 | A * | 9/1986 | Thieux | 241/243 |
| 5,273,218 | A * | 12/1993 | Burns | 241/32 |
| 5,553,797 | A * | 9/1996 | Axelsson et al. | 241/285.3 |
| 5,746,377 | A | 5/1998 | Gehrig | |
| 7,255,296 | B2 * | 8/2007 | Karlsson et al. | 241/285.3 |
| 7,600,708 | B2 * | 10/2009 | Karlsson et al. | 241/73 |
| 8,201,762 | B2 * | 6/2012 | Koslow | 241/91 |

FOREIGN PATENT DOCUMENTS

| | | | |
|---|---|---|---|
| DE | 4110239 | A1 | 10/1992 |
| DE | 19706425 | C1 | 4/1998 |
| WO | 03033154 | A1 | 4/2003 |
| WO | 03033156 | A1 | 4/2003 |
| WO | 2006053941 | A1 | 5/2006 |

OTHER PUBLICATIONS

International Search Report for corresponding International Application PCT/SE2009/000341.

* cited by examiner

*Primary Examiner* — Faye Francis
(74) *Attorney, Agent, or Firm* — WRB-IP LLP

(57) ABSTRACT

A granulator mill has a mill housing with a fixed section and an openable hatch, which is pivotally connected to the fixed section by the intermediary of a first pivot with a vertical pivot axis. The openable hatch has a first part and a second part, which are pivotally connected to one another by the intermediary of a second pivot with a vertical pivot axis.

7 Claims, 4 Drawing Sheets

GRANULATOR MILL

BACKGROUND AND SUMMARY

The present invention relates to a granulator which comprises a granulator mill housing with a fixed section and an opening hatch which is pivotally connected to the fixed section by the intermediary of a first pivot with a substantially vertical first pivot axis, the granulator mill housing having a number of fixed knives, a rotor rotatably disposed in the granulator mill housing, with a number of knives, and a discharge section for discharging granulate material.

In the employment of granulators in the plastics industry for recovery or recycling of plastics materials, it is necessary to carefully clean the interior of the granulator before changing from one plastics quality or colour to another. This implies requirements that the interior of the granulator be readily accessible for cleaning. This also applies to the discharge section of the granulator in which the granulate material is accumulated and from which it is discharged, often via conduits or chutes. For this reason, it is previously known in the art to design a granulator in such a manner that its granulator mill housing has an opening section or a hatch, by the intermediary of which the interior of the granulator mill housing and the rotor disposed therein are rendered accessible.

There is also a trend in the plastics industry that granulators are produced in increasingly larger sizes. This implies that the opening section or hatch of the granulator mill housing will be of considerable weight, which requires machine power for opening and closing if the pivot axis of the hatch is horizontal.

WO 03/033156 discloses a granulator of the above-outlined, prior art type. According to this publication, the problem inherent in a large and heavy opening section of the granulator mill housing is solved in that this section is pivotally disposed about a vertical axis. According to this publication, the opening section is pivotal within a large angle sector, so that extremely good accessibility to the interior of the granulator mill housing, the rotor and also the discharge section of the granulator is achieved.

Surrounding granulators in an industrial environment, there is often a considerable quantity of peripheral equipment, for which reason space is often at a premium. In a large granulator of the type which is illustrated in WO 03/033156, the opening section of the granulator mill housing may have a length in excess of 1 m. This implies that the sweep surface in which the opening section moves on opening and closing, often of the order of magnitude of 180°, is considerable and naturally must be kept completely free of peripheral equipment.

It is desirable to design the granulator described by way of introduction such that the drawbacks inherent in the prior art technology are obviated. In particular, it is desirable to design the granulator so that its interior may be accessed in an extremely simple manner for cleaning, with attendant superior accessibility both to the interior of the granulator mill housing, the rotor disposed therein and the discharge section of the granulator, without the need for a large space free of peripheral equipment in order to permit opening of the opening section or hatch of the granulator.

According to an aspect of the present invention, a granulator intimated by way of introduction is characterised in that the opening hatch comprises a first and a second part which are pivotally connected to one another via a second pivot with a substantially vertical pivot axis.

BRIEF DESCRIPTION OF THE ACCOMPANYING DRAWINGS

The present invention will now be described in greater detail hereinbelow, with reference to the accompanying Drawings. In the accompanying Drawings.

DETAILED DESCRIPTION

Figure 1:
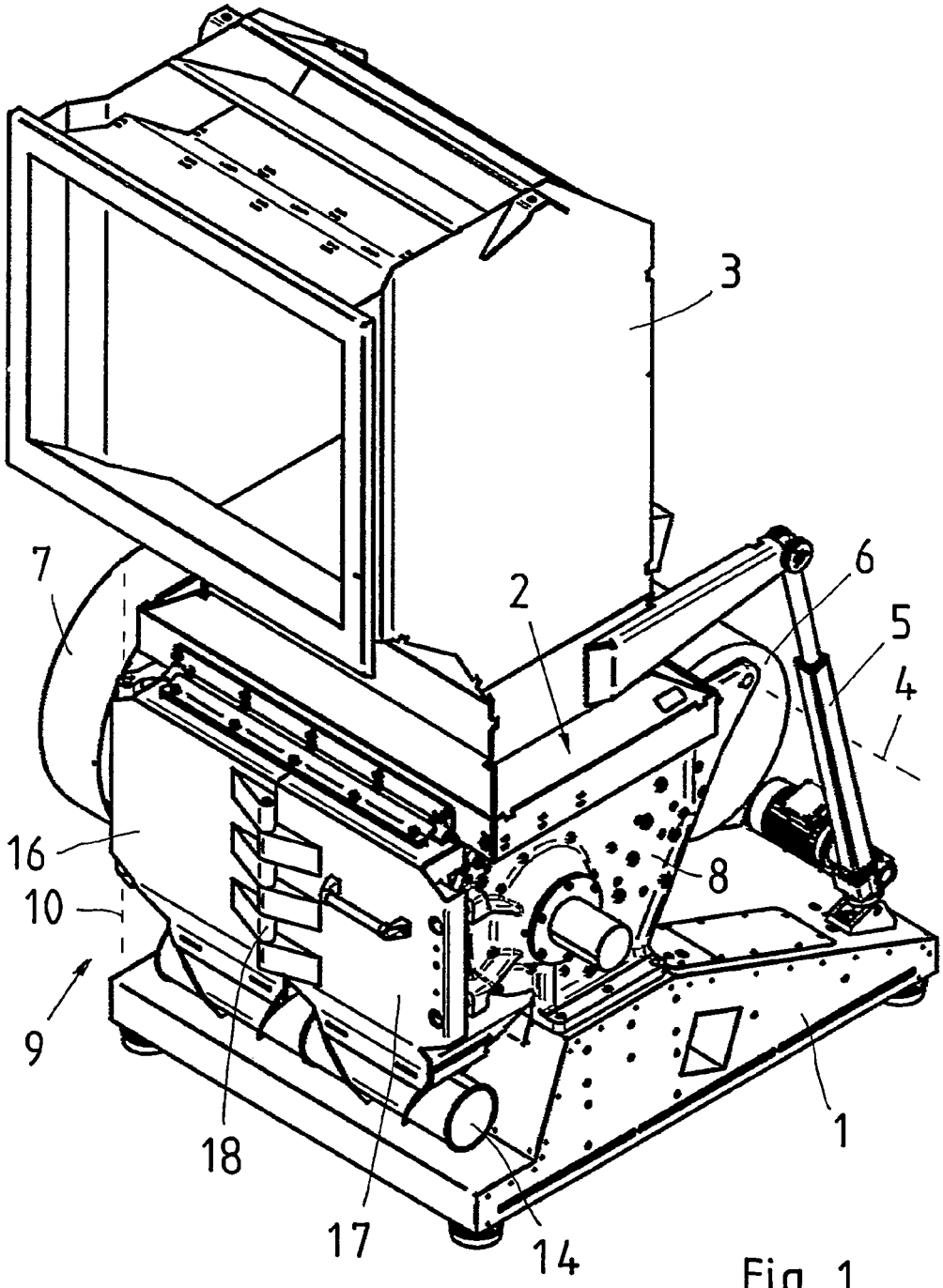
FIG. 1 is a perspective view of a granulator according to the present invention.

Referring to the Drawings, the granulator illustrated in FIG. 1 has a foundation bed 1 which is of a considerable mass, with a view to damping vibrations and noise as far as possible. On the foundation bed 1, there is disposed a granulator mill housing 2 which accommodates a rotor provided with knives (not shown in FIG. 1). On the upper side of the granulator mill housing 2, there is disposed an infeed or hopper section 3 which, for opening is pivotal about a horizontal axis 4 so that, in the open position of the infeed section 3, the whole of the upper side and the rotor disposed interiorly therein will be accessible from above. Given that the relevant granulator is of considerable dimensions, the infeed section 3 is of such extreme weight that it cannot be operated manually, but requires a motor-driven screw mechanism 5 for its opening and closing.

Driving of the rotor disposed interiorly in the granulator mill housing 2 is put into effect by the intermediary of a belt transmission (in FIG. 1 on the rear side of the granulator mill housing), the belt transmission being protected by a transmission hood 7.

The granulator mill housing 2 has a fixed section 8 which is secured on the foundation bed 1, and an opening section or hatch 9. A granulator of the size under consideration here may have an axial length of the rotor disposed interiorly in the granulator mill housing exceeding 1 m, for which reason the hatch 9 will have a corresponding dimensioning. This implies that the hatch 9 will be of considerable weight, of the order of magnitude of 200 to 300 kg. In order to make for manual opening and closing of such a heavy hatch, it is vital, during the opening and closing movement, that the point of gravity of the hatch is not changed in the vertical direction. For this reason, the hatch 9 is secured in the fixed section 8 of the granulator mill housing by the intermediary of a pivot which has a substantially vertical pivot axis 10.

Figure 2:
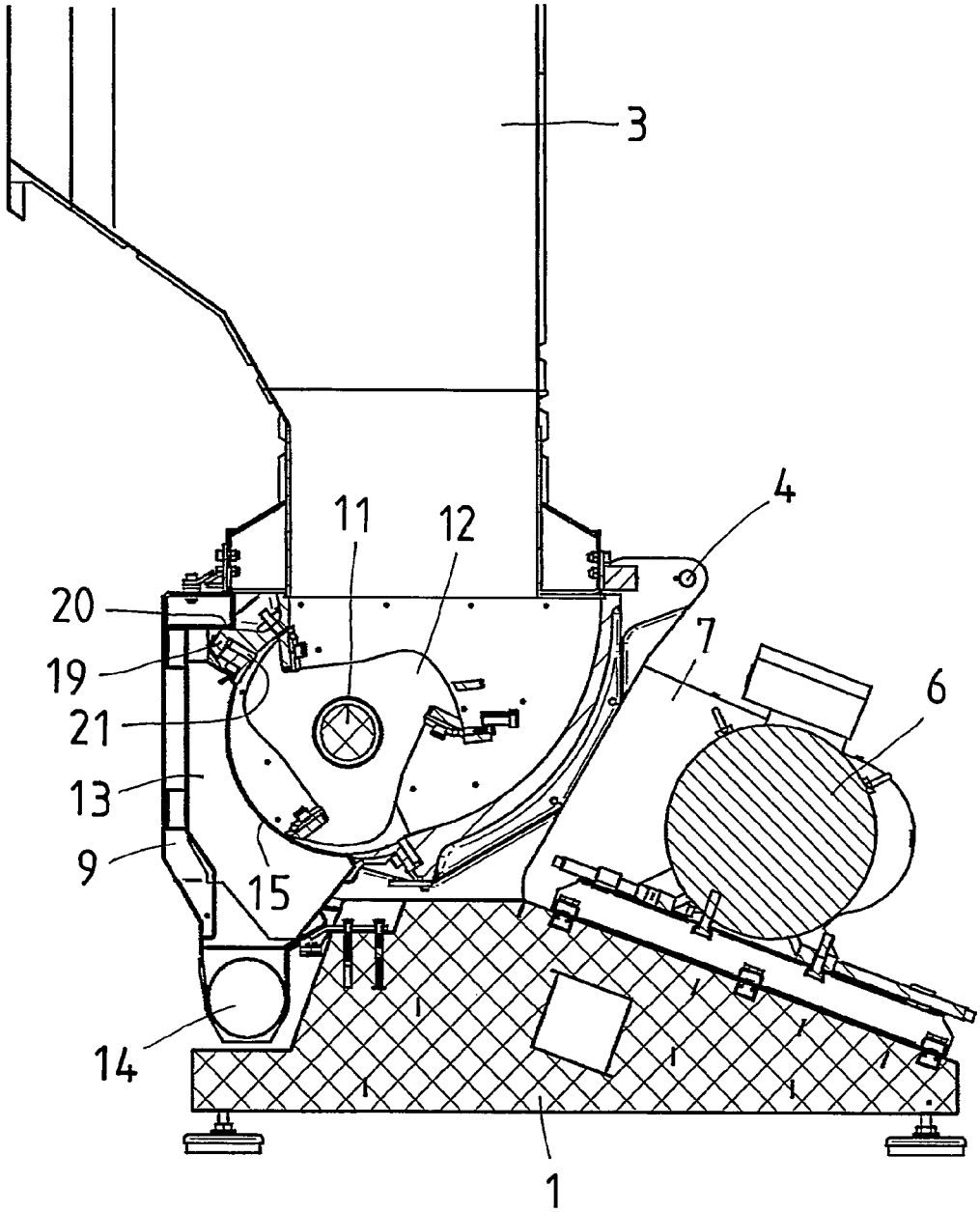
FIG. 2 is a section through the granulator according to FIG. 1, the section lying at right angles to the axis of rotation of a rotor disposed in the granulator.

FIG. 2 is a vertical section through the granulator according to the present invention, the section lying at right angles in relation to the axis of rotation 11 of the rotor 12 which is disposed interiorly in the granulator mill housing 2. It will be apparent from the Figure that the rotor has three knives, and that a corresponding number of fixed knives is disposed interiorly in the granulator mill housing. It should be observed, in FIG. 2, that the pivot axis 4 of the infeed section 3 is located a distance (to the right in the Figure) outside the fixed section of the granulator mill housing, which will have as a consequence that an extremely good level of accessibility to the interior of the granulator mill housing will be achieved when the infeed section is pivoted clockwise to the open position.

It will further be apparent from FIG. 2 that the discharge section 13 of the granulator is secured on and movable together with the hatch 9, the discharge section 13 having a pipe connection socket 14 at its lower end. Between the discharge section 13 and that space in which the rotor 12 rotates, there is a grill or screen 15 through which ready-granulated material passes from the interior of the granulator mill housing to the discharge section 13.

Figure 4:
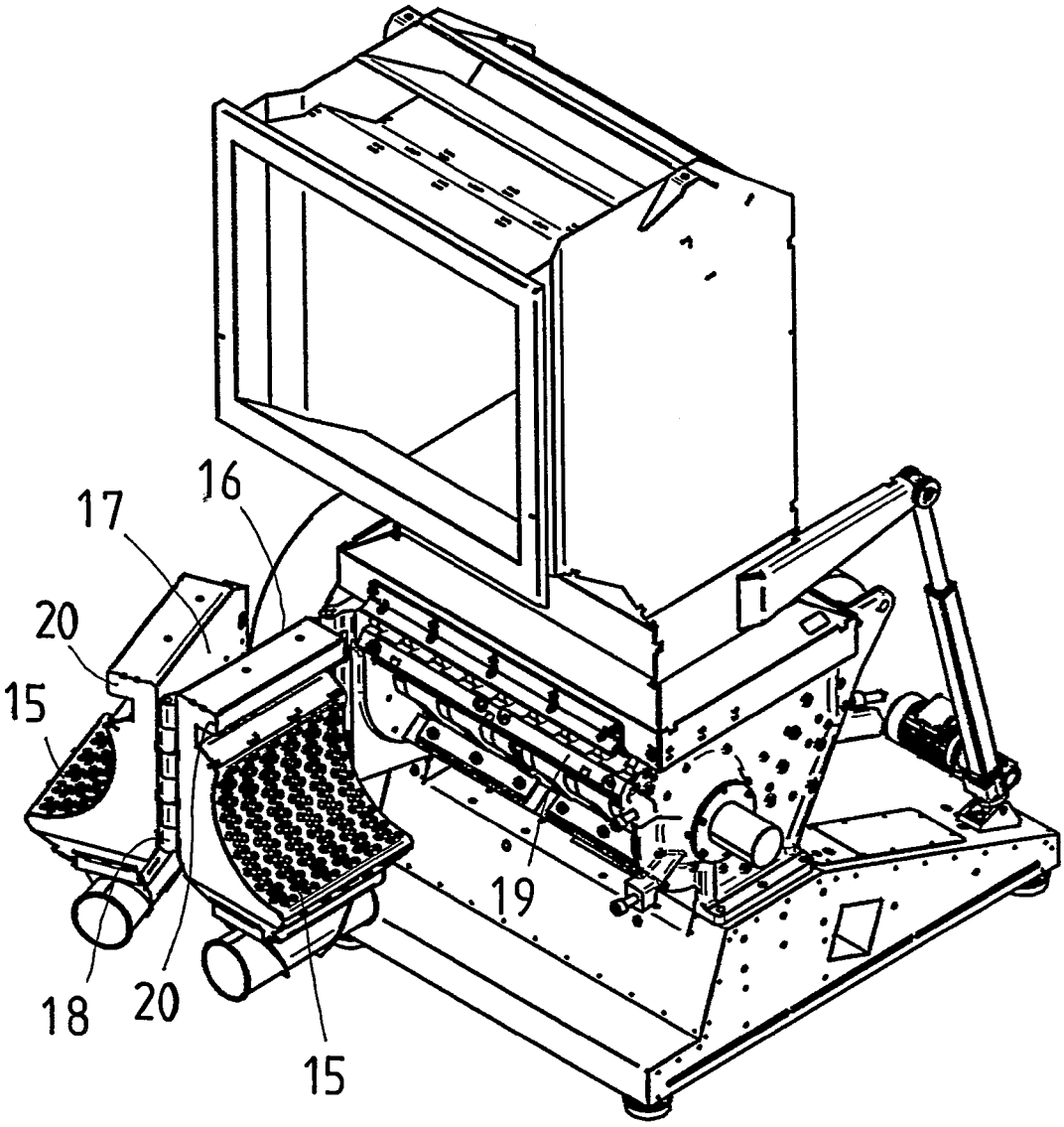
FIG. 4 is a view corresponding to that of FIGS. 1 and 3, the hatch included in the granulator mill housing having been given a considerably greater degree of opening.

It will be apparent from FIG. 1 that the hatch 9 has a first part 16 and a second part 17 which are interconnected to one another by the intermediary of a second pivot 18 which also has a substantially vertical pivot axis, which is thus substantially parallel with the pivot axis 10 of the first pivot. The second pivot 18 is designed in such a manner that it has a pivotal sweep which largely amounts to 180° from the position in FIG. 1 where both parts 16 and 17 of the hatch 9 coplanar with one another to a pivotal position where the second part 17 of the hatch has been pivoted through approximately 180° in order to lie planar along the outside of the first part 16 of the hatch, approximately as shown in FIG. 4.

Figure 3:
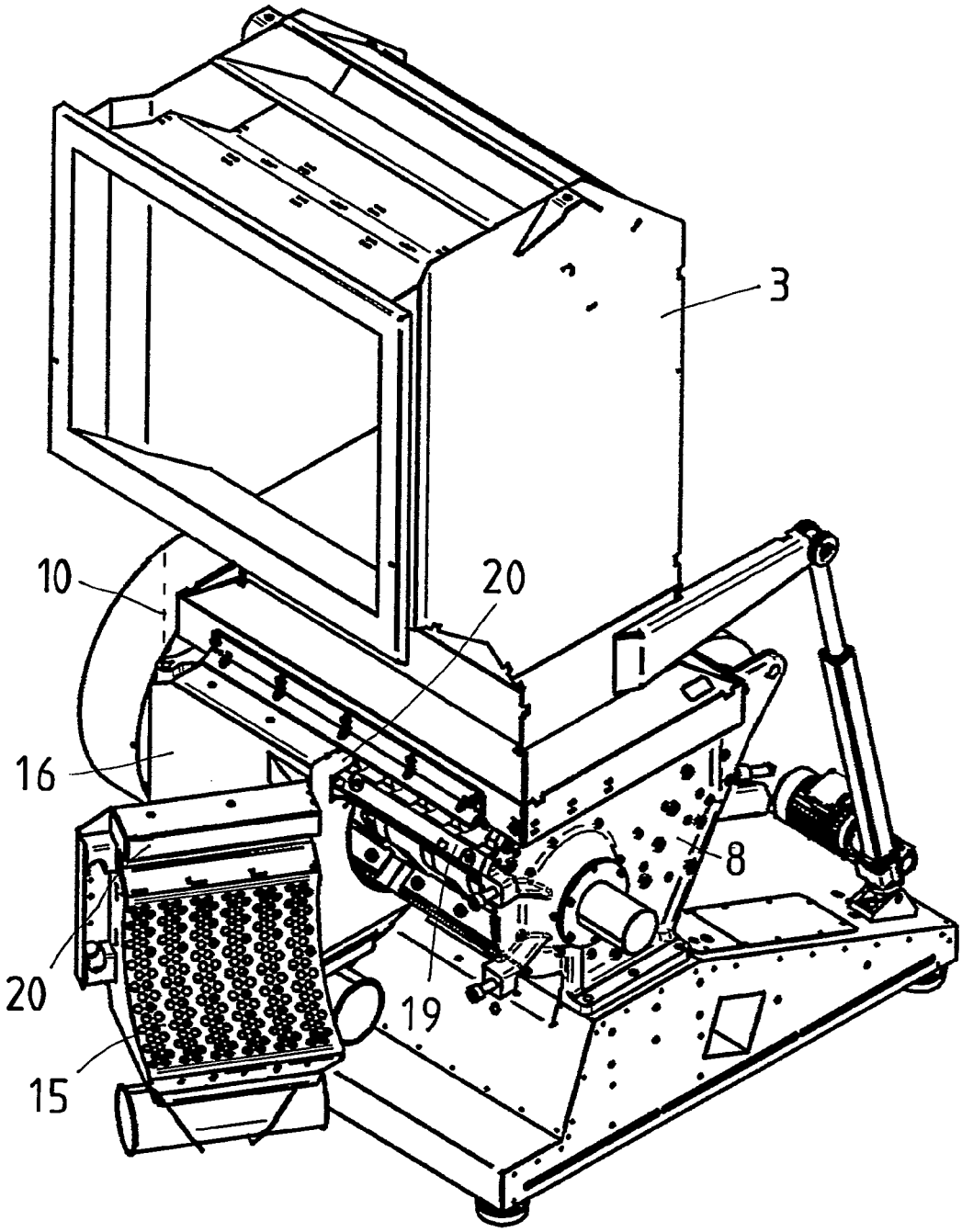
FIG. 3 is a view corresponding to that of FIG. 1, a hatch included in the granulator mill housing being partly opened.

If, as shown in FIG. 3, the second part 17 of the hatch 9 is pivoted by means of the pivot 18 and is positioned along the first part 16 of the hatch, it will readily be perceived that the space which, in front of the granulator, must be kept free to permit opening of the hatch, has been halved compared with if the hatch had consisted of a single rigid, continuous unit. From the position illustrated in FIG. 3, both parts of the hatch may then be pivoted together about the pivot axis 10, as shown in FIG. 4, and a further distance so that the interior of the granulator will be freely accessible.

The fixed section 8 of the granulator mill housing 2 has two end walls in which the rotor 12 is rotatably journalled. Between the upper edges of these end walls and at that side where the hatch 9 is located, the end walls are interconnected to one another via a beam 19. The hatch displays, along its upper edge (applies both to the first part 16 and the second part 17), a bead or strip 20 directed towards the interior of the granulator mill housing 2, the bead, in the closed position of the hatch, resting on the upper side of the beam 19 and abutting against it. This implies that, despite the considerable weight of the hatch, no sagging or dependence of the hatch at the first pivot 10 will be able to take place. Since the strip or bead 20 on the first part 16 of the hatch, on closure of the hatch close to the pivot axis 10, slides on the upper side of the shelf of the beam 19, the support point of the hatch will be displaced in a radial direction away from the pivot axis gradually as closure of the hatch takes place. Hereby, despite a certain clearance and outward flexing in material included in the machine, the hatch will be well positionally fixed in the vertical direction throughout the entire closing process and naturally also in the closed state.

It will further be apparent from FIG. 2 that the beam 19 is provided with a fixed knife, for which reason the hatch need not be provided with such a knife. As a result, the cutting forces will be taken up by the beam and not load the hatch 9, which moreover implies less stringent requirements on precision in the position of the hatch during operation.

Ideally, the first and second parts of the hatch 16 and 17, respectively, are of equal length seen in the longitudinal direction of the axis of rotation 11 of the rotor 12 in the closed position of the hatch. This also applies to the discharge section, which is thus divided, with an equally large part on each part of the hatch. As a result, the above-mentioned grill 15 may be of equal size on both parts of the hatch.

It will also be apparent from FIG. 2 that the hatch and the discharge section 13 disposed thereon have a large circumferential angle or sweep angle of the periphery of the rotor, in the order of magnitude of 140-180°. In view hereof, the discharge section 13 supported by the hatch 9 extends in beneath the rotor to an area substantially straight under the axis of rotation 11 of the rotor 12.

What is claimed is:

1. A granulator comprising a granulator mill housing with a fixed section and an opening hatch which is pivotally connected to the fixed section by the intermediary of a first pivot with a substantially vertical first pivot axis, the granulator mill housing having a number of fixed knives, as rotor rotatably disposed in the granulator mill housing, with a number of knives, and a discharge section for discharging granulate material, wherein the opening hatch comprises a first part and a second part which are pivotally connected to one another at a second pivot with a substantially vertical second pivot axis.

2. The granulator as claimed in claim 1, wherein the discharge section is divided, with a first part supported by and movable together with the first part of the hatch and a second part supported by and movable with the second part of the hatch.

3. The granulator as claimed in claim 1, wherein both parts of the hatch have substantially the same length seen in a direction which, when the hatch is closed, is parallel with the avis of rotation of the rotor.

4. The granulator as claimed in claim 1, wherein the second pivot has a pivotal range or sweep which amounts to substantially 180°.

5. The granulator as claimed in claim 1, wherein the fixed section of the granulator mill housing has, between its end walls and secured therein, a beam whose longitudinal direction is parallel with the axis of rotation of the rotor; and that the hatch has, on its inside, an elongate strip or bead which, in the closed position of the hatch, rests on the beam.

6. The granulator as claimed in claim 1, wherein the fixed knives are disposed exclusively in the fixed section of the granulator mill housing.

7. The granulator as claimed in claim 1, wherein the hatch, with the discharge section disposed thereon, extends in beneath the rotor substantially to an area vertically under the axis of rotation of the rotor.

* * * * *